US006154554A

United States Patent [19]

Kondo

[11] Patent Number: 6,154,554

[45] **Date of Patent: *Nov. 28, 2000**

[54] MICROPHONE

[75] Inventor: Kazuhisa Kondo, Yamato, Japan

[73] Assignee: Kabushiki Kaisha Audio-Technica, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/744,615

[22] Filed: Nov. 6, 1996

[30] Foreign Application Priority Data

Apr. 30, 1996 [JP] Japan ..... 8-132820

[51] Int. Cl.[7] ..... H04R 25/00

[52] U.S. Cl. ..... 381/355; 381/353; 381/360

[58] Field of Search ..... 381/168, 169, 381/177, 170, 174, 345, 346, 347, 350, 351, 353, 354, 355, 360, 147, 148

[56] References Cited

U.S. PATENT DOCUMENTS

| | | | |
|---|---|---|---|
| 3,819,879 | 6/1974 | Baechtold | 381/353 |
| 3,947,646 | 3/1976 | Saito | 381/169 |
| 4,189,627 | 2/1980 | Flanagan | 381/353 |

FOREIGN PATENT DOCUMENTS

| | | | |
|---|---|---|---|
| 174220 | 3/1935 | Switzerland | 381/169 |

*Primary Examiner*—Huyen Le
*Attorney, Agent, or Firm*—Welsh & Katz, Ltd.

[57] ABSTRACT

The present invention provides a microphone in which a first acoustic capacity for mainly determining resonance frequency and a second acoustic capacity for mainly determining resonance sharpness are defined in a resonance portion, said first acoustic capacity and said second acoustic capacity being arranged in parallel in a direction of crossing relative to a moving direction of a sound wave, said second acoustic capacity capable of being communicated with only said first acoustic capacity to control resonance frequency.

10 Claims, 5 Drawing Sheets

MICROPHONE

FIELD OF THE INVENTION

The present invention relates to a microphone which can control resonance frequency, without particularly using parts for acoustic resistance, to improve sensitivity of a high sound level, which can set resonance frequency to a desired value without lowering sensitivity and which is less in restrictions in design.

DESCRIPTION OF RELATED ART

A conventional microphone is shown in FIG. 4A. In this microphone 40, a microphone unit 42 is accommodated in a substantially cylindrical casing 41, and a resonance portion 43 is provided between the end of the casing and the front surface of the microphone unit 42.

A resonance resonator 44 is mounted on the end of the casing 41 to set resonance frequency to a desired value. An acoustic resistor 45 is arranged within the resonance portion 43 to set resonance sharpness to a desired value.

The resonator 44 is in the form of a substantially deep plate to close the end of the casing 41 and is provided with an opening 46 capable introducing a sound wave into the resonance portion 43.

The resonator 44 is formed so that resonance frequency of the microphone 40 assumes a desired value, that is, the resonance portion 43 assumes a desired acoustic capacity.

On the other hand, the acoustic resistor 45 is made, for example, of sponge, is present in an acoustic capacity portion of the resonance portion 43 set by the resonator 44 and is pressed and secured to the front surface of the microphone unit 42.

As shown in FIG. 4B showing an acoustic equivalent circuit, the acoustic resistor 45 makes resonance sharpness of the microphone to a desired value, and serves as an acoustic series resistor in the resonance portion 43 to control resonance.

However, the microphone 40 involves a problem in that since the resonance portion 43 and the acoustic resistor 45 constitute a lowpass filter relative to high frequency, high level sensitivity lowers, as shown in FIG. 5.

The microphone 40 further involves a problem in that since an acoustic resistor 45 need be separately arranged within the acoustic capacity in order to control resonance, the number of parts increases to render the assembling operation troublesome.

Further, in such a microphone 40 as described, in the case where the microphone unit 42 is of a single directivity, when a high acoustic resistor 45 is used, the directivity possibly changes greatly.

Accordingly, it is necessary to take these matter described above into consideration in designing the microphone 40. There also involves a problem in that a desired external appearance is difficult to obtain.

SUMMARY OF THE INVENTION

The present invention is intended to solve the problems noted above and provides a microphone which can control resonance frequency, without particularly using parts for acoustic resistance, to improve sensitivity of a high sound level, which can set resonance frequency to a desired value without lowering sensitivity and which is less in restrictions in design.

The microphone according to the present invention comprises a microphone unit accommodated in a tubular casing, a resonance portion provided on the front surface of said microphone unit, a first acoustic capacity for mainly determining resonance frequency and a second acoustic capacity for mainly determining resonance sharpness, which are provided within said resonance porion, a resonator formed so as to close a peripheral end of said casing and provided with an opening for introducing a sound wave, and a resonance control means in which said first acoustic capacity and said second acoustic capacity are arranged in parallel in a direction of crossing with respect to a moving direction of a sound wave, said second acoustic capacity capable of interacting with said first acoustic capacity to control resonanse frequency.

With respect to said second acoustic capacity and said first acoustic capacity, for example, a tubular wall extending in a moving direction of a sound wave is inserted into and arranged in the resonance portion, and one out of an inner peripheral space and an outer peripheral space of the wall constitutes the first acoustic capacity whereas the other constitutes the second acoustic capacity.

The second acoustic capacity closes an opening of the resonance portion, and can be communicated with only the first acoustic capacity through communication holes provided in the wall.

While the tubular wall is arranged in the same axis as the casing, it is to be noted that the tubular wall can be arranged eccentric relative to the axis of the casing. The wall may be provided in the form of a flat plate or in the form of X extending in a moving direction of a sound wave. The resonance portion may be divided into two or more sections.

The communication holes provided in the wall may be suitably formed at suitable locations in the peripheral surfaceof the wall. Alternatively, a clearance formed between the end of the wall and the front surface of the microphone unit may be used.

In the present invention, the communication hole provided in the wall will be an acoustic impedance between the first acoustic capacity and the second acoustic capacity, the resonance of a sound wave moving through the first acoustic capacity is controlled by the said acoustic impedance and the impedance in the second acoustic capacity.

Accordingly, in the present invention, it is not necessary to provide acoustic resistance materials as in prior art in order to control resonance, thus reducing the number of parts and simplifying the assembling process.

Further, since the first acoustic capacity and the second acoustic capacity are arranged in parallel in a direction of crossing with respect to a moving direction of a sound wave, the resonance of a sound wave is controlled by a parallel acoustic circuit. That is, a high level sensitivity in excess of resonance frequency is not lowered as compared with the case where the resonance is controlled by series resistors formed by arranging the acoustic resistance materials in the resonance portion as in prior art.

Furthermore, since the resonance of a sound wave is controlled by the parallel acoustic circuit, even in the case where the microphone unit is of a single directivity, the directivity is less changed even if the acoustic resistance value is increased as in the conventional series resistors. That is, restrictions in design is relieved as compared with prior art.

A main air chamber for setting the first acoustic capacity is separated from a sub air chamber for setting the second acoustic capacity by the wall provided in the resonance portion. With this construction, miniaturization can be achieved and desired shape can be obtained as compared with the case where the sub air chamber is arranged outside of the casing.

Moreover, a tubular resonator capable of being inserted into the resonance portion is mounted on the end of the casing, and the main air chamber and the sub air chamber can be automatically formed to further simplify the assembling process.

DESCRIPTION OF THE PREFERRED EMBODIMENTS

Figure 4A:
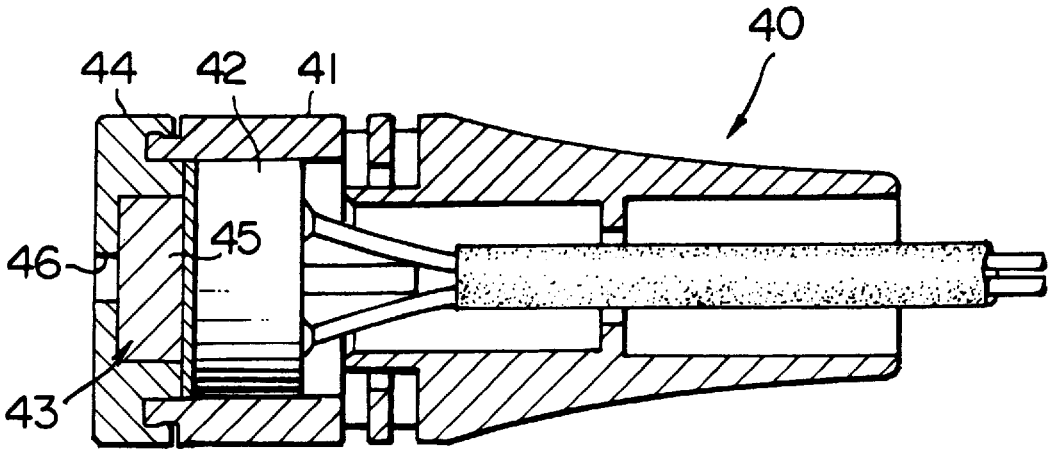
FIG. 4A (Prior Art)
FIG. 4A is a sectional view of a conventional microphone.
Figure 4B:
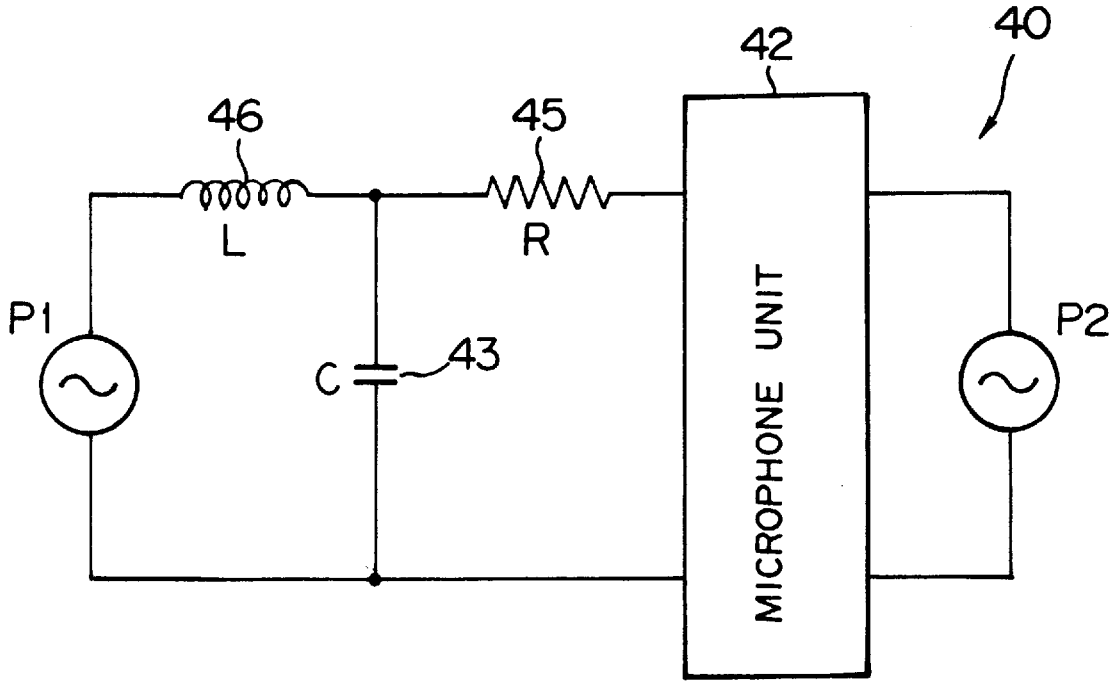
FIG. 4B (Prior Art)
FIG. 4B shows an acoustic equivalent circuit of a conventional microphone.
Figure 5:
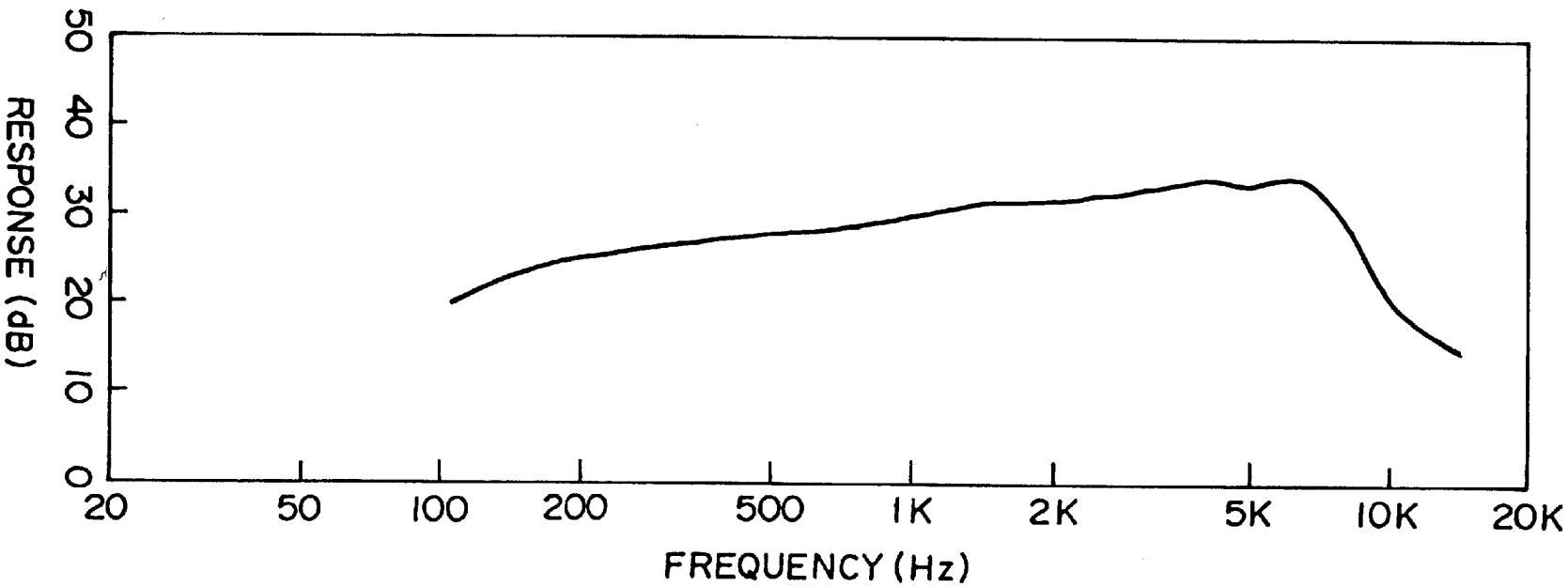
FIG. 5 (Prior Art)
FIG. 5 is a graph showing the characteristics of a conventional microphone.

The embodiments of the present invention will be described hereinafter with reference to the drawings. With respect to the members already explained in connection with FIG. 4, these members are designated by the same reference numerals in the following, and description thereof is simplified or omitted.

Figure 1A:
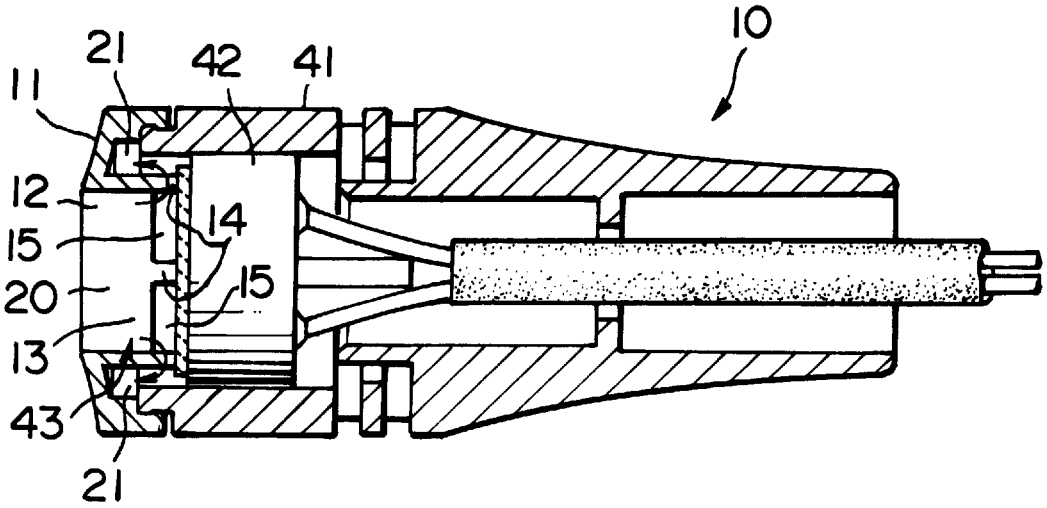
FIG. 1A is a sectional view of a microphone according to one embodiment of the present invention.

One embodiment of the present invention will be described with reference to FIGS. 1A and 1B. A microphone 10 has a resonator 11 mounted on the end (left end in the figure) of a casing 41 as shown in FIG. 1A.

The resonator 11 is in the form of a substantially deep plate for closing the end of the casing 41 and comprises an opening 12 capable of introducing a sound wave into a resonance portion 43 and a wall 13 connected to the opening 12.

The opening 12 is formed to be circular and is provided in the center of the resonator. Accordingly, the opening 12 is to be arranged on the same axis as the casing 41 when the resonator 11 is mounted on the end of the casing 41.

On the other hand, the wall 13 is formed to be substantially cylindrical, and the inner peripheral surface thereof is continuous to the opening 12. The wall 13 is that when four legs 14 provided on the end come in contact with the front surface of the microphone unit 42, a clearance 15 is formed between the wall 13 and the microphone unit 42.

The wall 13 has a main air chamber 20 as a first acoustic capacity defined in the inner periphery thereof, and a sub air chamber 21 defined as a second acoustic capacity in the outer periphery thereof.

The sub air chamber 21 can be communicated with only the main air chamber 20 through the clearance 15 and is acoustically coupled to the main air chamber 20.

The microphone 10 is constructed as described above, and mainly resonance frequency is determined by the acoustic capacity of the main air chamber 20 whereas mainly resonance sharpness is determined by the acoustic capacity of the sub air chamber 21.

Figure 1B:
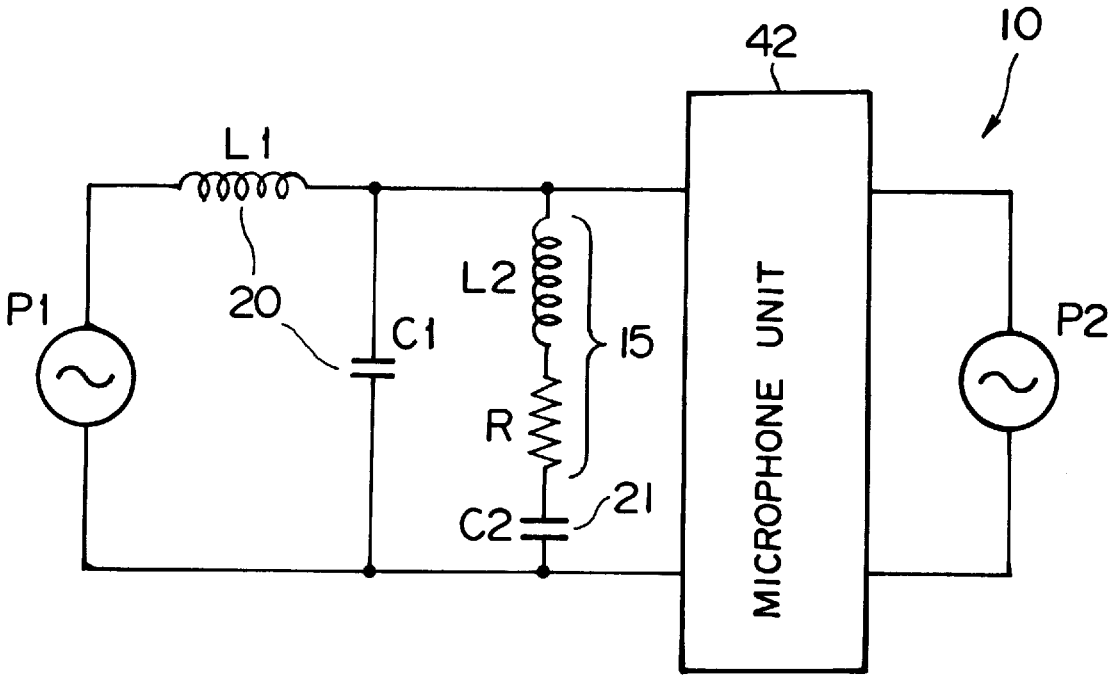
FIG. 1B shows an acoustic equivalent circuit of a microphone according to one embodiment of the present invention.

More specifically, as shown in an acoustic equivalent circuit view of FIG. 1B, the microphone 10 is that the sub air chamber 21 and the clearance 15 for introducing a sound wave operate as an acoustic impedance, and resonance of the main air chamber 20 is controlled by a parallel acoustic circuit comprising the main air chamber 20 and the sub air chamber 21.

Accordingly, in the resonator 11, the wall 13 is formed so that the resonance sharpness of the high level resonance characteristics of the microphone 10 assumes a desired value in advance, that is, the clearance 15 has suitable shape and size.

Figure 2:
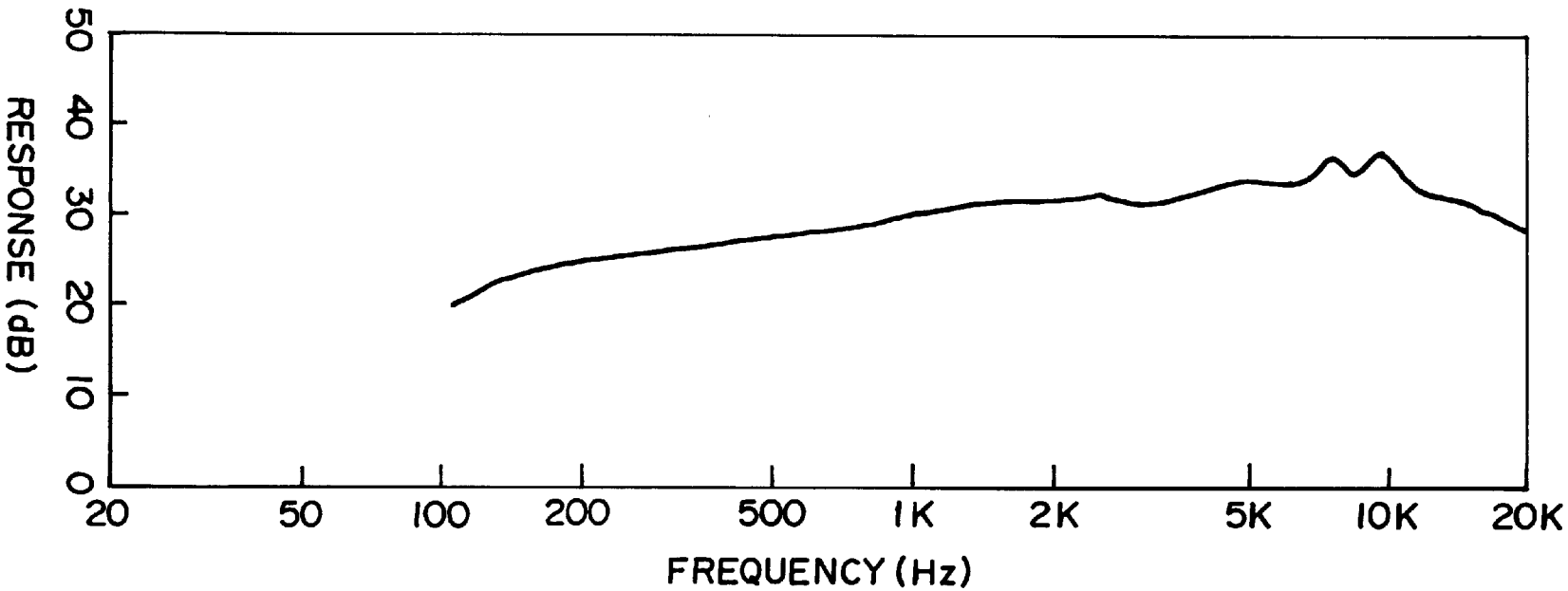
FIG. 2 is a graph showing the characteristics of a microphone according to one embodiment of the present invention.

As described above, according to the microphone 10 in the present embodiment, the resonance is controlled by the parallel acoustic circuit composed of the main air chamber 20 (first acoustic capacity) and the sub air chamber 21 (second acoustic capacity) arranged in parallel in a direction of crossing relative to the moving direction of a sound wave. Therefore, as shown in FIG. 2, substantially even sensitivity is obtained over the whole level, and the high level sensitivity is not lowered as in the conventional microphone.

Since the microphone 10 uses no acoustic resistance materials for controlling the resonance as in the conventional microphone, it is possible to reduce the number of constituent parts to simplify the assembling process.

Further, in the microphone 10, since the resonance of a sound wave is controlled by the parallel acoustic circuit, even if the microphone unit is of a single directivity, the directivity is less changed even if the acoustic impedance is made large as in the series resistors of prior art.

Accordingly, the microphone 10 has less restrictions in design as compared with the conventional microphone, and the microphone having a desired shape can be readily obtained.

Further, in the microphone 10 according to this embodiment, since the main air chamber 20 as the first acoustic capacity and the sub air chamber 21 as the second acoustic capacity are formed interiorly of the resonance portion 43, the casing 41 will not be larger in scale.

Further, in the microphone 10, the main air chamber 20 and the sub air chamber 21 are automatically formed by the extremely simple operation of mounting the resonator 11 on the end of the casing 41, thus further simplifying the assembling process.

It is to be noted that the microphone is not limited to that illustrated in the above-described embodiment but includes a microphone 10A to 10D shown in FIGS. 3A to 3D, for example.

Figure 3A:
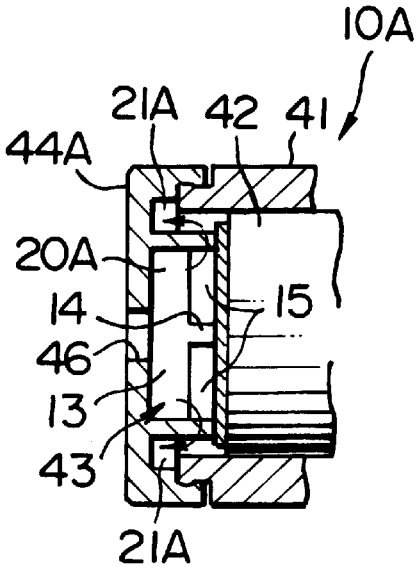
FIGS. 3A, B, C and D are respectively sectional views and schematic views showing modifications of the present invention.

That is, in the microphone 10A shown in FIG. 3A, a main air chamber 20A as a first acoustic capacity and a sub air chamber 21A as a second acoustic capacity are formed by a resonator 44A which partly removes parts of the resonator used in the conventional microphone. Thereby, the effect similar to that of the previous embodiment can be obtained.

Figure 3B:
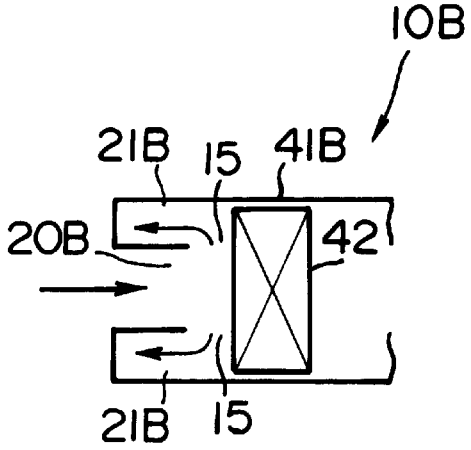

Further, in the microphone 10B shown in FIG. 3B, a sub air chamber 21B is integrally molded on the end of a casing 41B in advance, and the resonance of a sound wave which moves through a main air chamber 20B is controlled by the clearance 15 and the sub air chamber 21.

Figure 3C:
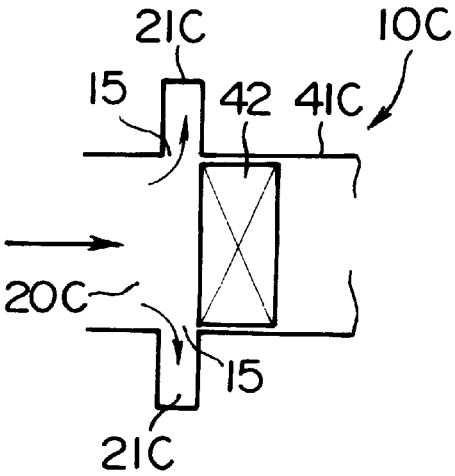

Moreover, in a microphone 10C shown in FIG. 3C, a sub air chamber 21C is projected in a diametral direction of a casing 41C, and the resonance of a sound wave which moves through a main air chamber 20C is controlled by the clearance 15.

Figure 3D:
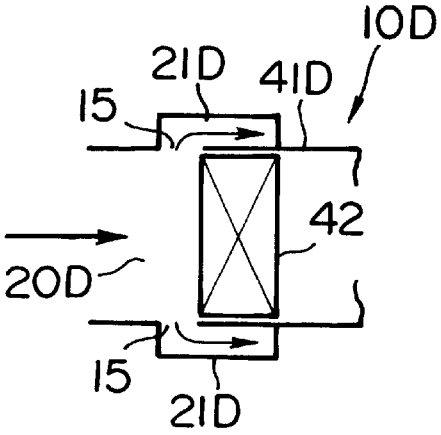

In a microphone 10D shown in FIG. 3D, a sub air chamber 21D is formed in an axial direction of the outer peripheral surface of the casing 41C, and the resonance of a sound wave which moves through a main air chamber 20D is controlled by the clearance 15 and the sub air chamber 21.

The effect similar to that of the previous embodiment can be obtained also by these microphones 10B to 10D.

With respect to the material, shape, dimension, configuration, number, location of arrangement of the resonator, casing, microphone unit, resonance portion, main air chamber as a first acoustic capacity, sub air chamber as a second acoustic capacity, wall, etc. illustrated in the previous embodiment, they are optional and not restricted as long as they can achieve the present invention.

What is claimed is:

1. A microphone including a microphone case; a resonator formed into the shape of a plate, said resonator having a front face corresponding to a bottom face of the plate and an opening on the front face for introducing sound waves thereinto, said resonator mounted to a forward portion of said microphone case to form a resonance portion; and a microphone unit in the microphone case directly adjacent said resonance portion for converting the sound waves passing through the opening of the resonator, into electric signals, said microphone further including said resonator having a diameter substantially equal to that of said microphone case and having an inner wall spaced from an inner face of said microphone case thereby dividing said resonance portion into a central air chamber having a first acoustic capacity with a constant arcular cross-section and a circumferential air chamber having a second acoustic capacity, said second acoustic capacity being concentric with said first acoustic capacity, said second acoustic capacity capable of communicating with said first acoustic capacity through a plurality of discrete openings in said wall separating said first acoustic capacity from said second acoustic capacity to control resonance frequency.

2. The microphone of claim 1, wherein said central air chamber with the first acoustic capacity and said circumferential air chamber with second acoustic capacity of the resonance portion determine resonant frequency and resonance sharpness, said resonant sharpness of the circumferential air chamber being determined by the shape and size of said openings of the wall.

3. The microphone of claim 2, wherein said microphone includes resonance control means for controlling resonance caused by said central air chamber, by affecting acoustic impedance in the combination of said circumferential air chamber and said openings.

4. The microphone of claim 1, wherein said microphone includes resonance control means for controlling resonance caused by said central air chamber, by affecting acoustic impedance in the combination of said circumferential air chamber and said openings.

5. A microphone including a tubular microphone case having a front face, and an opening on the front face for the entry of sound waves into the case, said opening operating as a resonator having a resonance portion; and a microphone unit directly adjacent the resonance portion in the tubular microphone case for converting the sound waves into electric signals, said microphone further including said microphone case having an inner wall spaced from said microphone case, the wall dividing the resonance portion into a main air chamber having a first acoustic capacity, and a sub air chamber having a second acoustic capacity, the main air chamber with the first acoustic capacity being on an inner face side of the wall, the sub air chamber with the second acoustic capacity being formed on an outer face side of the wall; and said wall having a plurality of discrete openings coupling said main air chamber with said sub air chamber, said second acoustic capacity capable of communicating with said first acoustic capacity through said openings to control resonance frequency.

6. The microphone of claim 5, wherein said wall is parallel with and spaced from the microphone case.

7. The microphone of claim 6, wherein an outer wall of said sub air chamber is formed by the microphone case.

8. The microphone of claim 5, wherein said main air chamber with the first acoustic capacity and said sub air chamber with the second acoustic capacity of the resonance potion determined a resonant frequency and a resonance sharpness, said resonant sharpness of the sub air chamber being determined depending on shape and size of said openings of the wall.

9. The microphone of claim 5, wherein said microphone includes resonance control means for controlling resonance caused by said main air chamber when operating said sub air chamber, and openings as an acoustic impedance.

10. A microphone comprising:

a microphone unit accommodated in a tubular casing;

a resonance portion provided on the front surface of said microphone unit;

a first acoustic capacity for mainly determining resonance frequency and a second acoustic capacity for mainly determining resonance sharpness, said first and second acoustic capacities provided within said resonance portion;

a resonator formed so as to close a peripheral end of said casing and having an opening for introducing a sound wave; and a resonance control means in which said first acoustic capacity and said second acoustic capacity are arranged in parallel along a common axis, said second acoustic capacity capable of communicating with said first acoustic capacity through a plurality of discrete openings in a wall separating said first acoustic capacity from said second acoustic capacity to control resonance frequency, and further including a main air chamber for setting said first acoustic capacity, said main air chamber being larger than said opening.

* * * * *

UNITED STATES PATENT AND TRADEMARK OFFICE

CERTIFICATE OF CORRECTION

PATENT NO. : 6,154,554
DATED : December 5, 2000
INVENTOR(S) : Inaoka et al.

It is certified that error appears in the above-identified patent and that said Letters Patent is hereby corrected as shown below:

Column 40, claim 6,
Line 2, should read -- of recombinant DNAs coding for the amino acid sequence --.

Column 42, claim 14,
First word of claim should read -- A --.
Beginning of second line should read -- of pUK-FPEP-15, --.

Signed and Sealed this

Eighth Day of January, 2002

*Attest:*

*Attesting Officer*

JAMES E. ROGAN
*Director of the United States Patent and Trademark Office*